US007682098B2

(12) United States Patent
Sandahl et al.

(10) Patent No.: US 7,682,098 B2
(45) Date of Patent: Mar. 23, 2010

(54) TWO STAGE DOUBLE PISTON MANUAL LIQUID APPLICATOR

(75) Inventors: Jeffrey E. Sandahl, Buffalo, MN (US); Shawn C. Johnson, Milaca, MN (US); Tim Wessels, Victoria, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 11/672,851

(22) Filed: Feb. 8, 2007

(65) Prior Publication Data

US 2008/0193196 A1 Aug. 14, 2008

(51) Int. Cl.
*B43K 5/04* (2006.01)

(52) U.S. Cl. ..... 401/170; 401/272

(58) Field of Classification Search ..... 401/170, 401/182, 197, 270–274, 151, 150, 144, 289; 15/144.4

See application file for complete search history.

(56) References Cited

U.S. PATENT DOCUMENTS

| | | | | |
|---|---|---|---|---|
| 305,041 | A | 9/1884 | Bentz | |
| 863,803 | A | 8/1907 | Luther | |
| 1,392,569 | A | 10/1921 | Hugetz | |
| 1,509,008 | A | 9/1924 | Wallace | |
| 1,509,420 | A | 9/1924 | Edelman | |
| 1,598,742 | A * | 9/1926 | Rufus | 401/10 |
| 1,618,930 | A | 2/1927 | Istrico | |
| 2,641,012 | A * | 6/1953 | Storrs | 15/144.4 |
| 2,957,448 | A | 10/1960 | George | |
| 2,964,769 | A | 12/1960 | Mercereau | |
| 3,337,899 | A | 8/1967 | Rentfrow | |
| 3,372,976 | A | 3/1968 | MacFarland | |
| 3,554,659 | A | 1/1971 | Stokes | |
| 3,702,739 | A | 11/1972 | Rentfrow | |
| 3,720,473 | A | 3/1973 | Nakata | |
| D231,131 | S | 4/1974 | Osborne et al. | |
| 4,457,641 | A | 7/1984 | Smith | |
| 4,695,176 | A | 9/1987 | Simonette et al. | |
| 4,732,503 | A | 3/1988 | Bader et al. | |
| 4,810,123 | A | 3/1989 | Bruggeman | |
| 4,824,272 | A | 4/1989 | Collins et al. | |
| 4,997,302 | A | 3/1991 | Simonette | |

(Continued)

OTHER PUBLICATIONS

International Search Report and Written Opinion of international application number PCT/US2007/087001, mailed Apr. 28, 2008, 12 pp.

*Primary Examiner*—Huyen Le
(74) *Attorney, Agent, or Firm*—Faegre & Benson LLP

(57) ABSTRACT

A liquid applicator having a collapsible liquid reservoir with an elongated outer chamber wall having a characteristic length, and a liquid delivery piston having a length substantially equal to the characteristic length, wherein the piston is telescopically received in the outer chamber wall, and an elongated intermediate chamber wall having a length substantially equal to the characteristic length and wherein the intermediate chamber wall is telescopically received in the outer chamber wall located circumferentially intermediate the piston and the outer chamber wall, wherein the liquid reservoir and piston may be telescopically expanded to either a fully expanded condition wherein the combined length of the liquid reservoir and piston is about three times the characteristic length or a partially expanded intermediate condition wherein the combined length of the liquid reservoir and piston is substantially less than half the length of the liquid reservoir and piston in the fully expanded condition.

8 Claims, 9 Drawing Sheets

U.S. PATENT DOCUMENTS

| | | | | |
|---|---|---|---|---|
| D342,342 | S | | 12/1993 | Maglione |
| D345,816 | S | | 4/1994 | Moore et al. |
| D364,948 | S | | 12/1995 | Hunt |
| 5,496,123 | A | | 3/1996 | Gaither |
| D385,060 | S | | 10/1997 | Burrell et al. |
| 5,810,027 | A | * | 9/1998 | Frantzeskakis ..... 132/320 |
| 5,881,601 | A | * | 3/1999 | Hammer ..... 74/422 |
| D408,148 | S | | 4/1999 | Frost et al. |
| 5,975,782 | A | | 11/1999 | Lee |
| D417,552 | S | | 12/1999 | Snetting et al. |
| 6,045,284 | A | * | 4/2000 | Chiu ..... 401/289 |
| 6,142,693 | A | | 11/2000 | Bruggeman et al. |
| 6,244,771 | B1 | | 6/2001 | Bruggeman et al. |
| D444,928 | S | | 7/2001 | Bruggeman et al. |
| D476,122 | S | | 6/2003 | Bruggeman et al. |
| 6,726,389 | B1 | | 4/2004 | Lee |
| 2007/0020035 | A1 | | 1/2007 | Bruggeman et al. |

* cited by examiner

TWO STAGE DOUBLE PISTON MANUAL LIQUID APPLICATOR

FIELD OF THE INVENTION

The present invention relates to the field of liquid coating applicators including, but not limited to painting equipment. More specifically, the invention relates to devices and methods for applying liquids including, but not limited to, paint and similar coatings (such as liquid stain) using an internally-fed manual powered roller or other liquid coating applicator head. The present invention is suitable for applying water or other liquids in the removal of wallpaper.

BACKGROUND OF THE INVENTION

Prior art paint applicators include conventional rollers, pad applicators and brushes. One advance in the prior art included a single stage internal feed paint roller, exemplified by U.S. Pat. No. 4,732,503 and Des 417,552, the entire contents of each of which are hereby incorporated by reference. Such internal feed paint applicators have found commercial success through wide acceptance and use by consumers. However, such applicators have a deficiency in that they are so long that they cannot be conveniently used in confined spaces such as closets. The paint reservoir and piston extend to such a length as to be impractical for use in confined spaces.

SUMMARY OF THE INVENTION

The present invention is an improvement over the relatively long length prior art internal feed liquid applicators in that it provides a liquid applicator useable in a shortened configuration or in an elongated configuration, without requiring any extra parts or special assembly or disassembly efforts on the part of the operator. The liquid applicator of the present invention is unlike the prior art applicators in that it includes a telescopically collapsible liquid reservoir. More particularly, the present invention further includes an elongated outer chamber wall having a characteristic length, a liquid delivery piston having a length substantially equal to the characteristic length, with the piston telescopically received in the outer chamber wall, and an elongated intermediate (or inner) chamber wall having a length substantially equal to the characteristic length. In the present invention, the intermediate chamber wall is telescopically received in the outer chamber wall and located circumferentially intermediate the piston and the outer chamber wall. The liquid reservoir and piston may be telescopically expanded either to a fully expanded condition wherein the combined length of the liquid reservoir and piston is about three times the characteristic length, or a partially expanded intermediate condition wherein the combined length of the liquid reservoir and piston is substantially less than half the length of the liquid reservoir and piston in the fully expanded condition.

The liquid applicator of the present invention may have the liquid reservoir and piston telescopically compressed to about one third the length of the liquid reservoir and piston in the fully expanded condition.

While a preferred embodiment is disclosed, other embodiments of the present invention will become apparent to those skilled in the art from the following detailed description, which shows and describes an illustrative embodiment of the invention. Accordingly, the drawings and detailed description are to be regarded as illustrative in nature and not restrictive.

DETAILED DESCRIPTION

Figure 1:
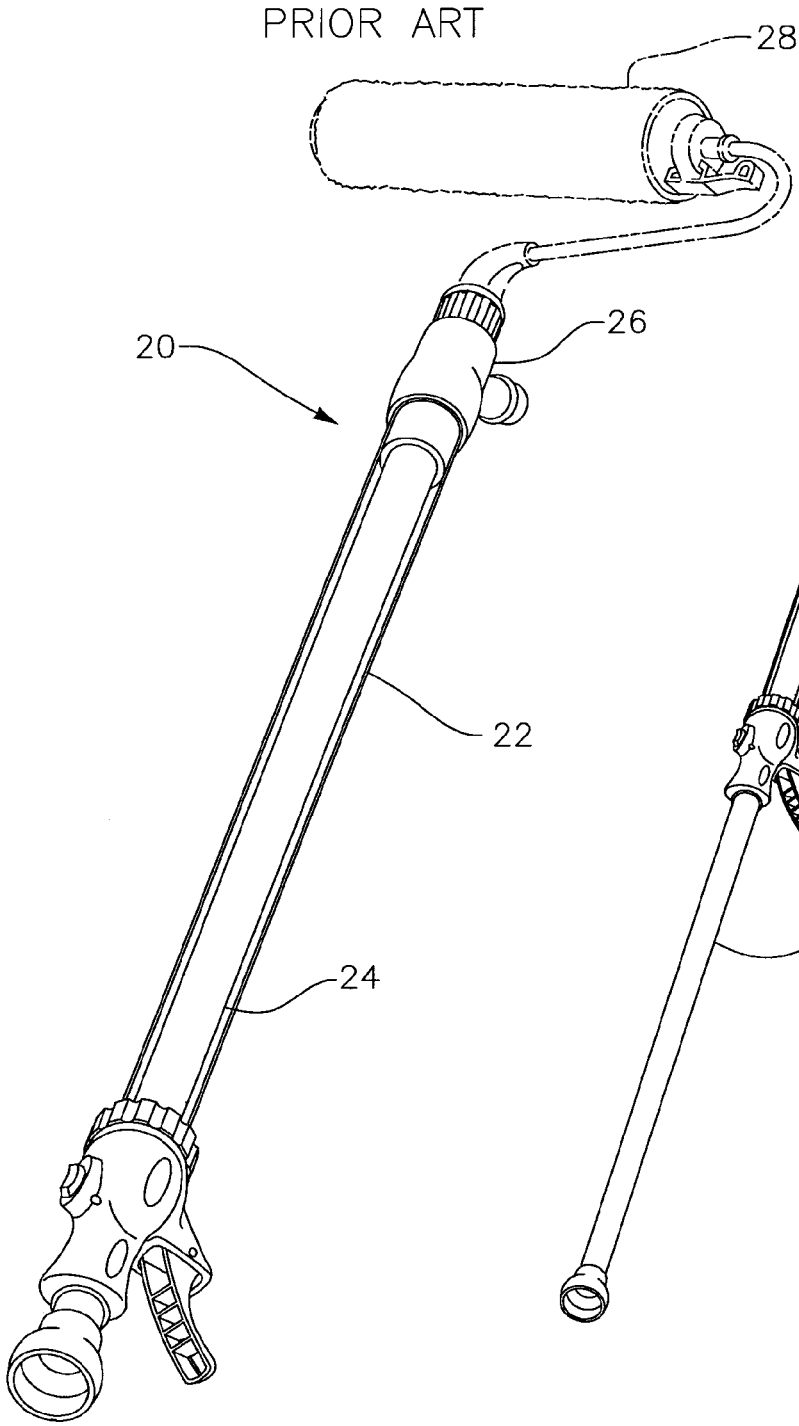
FIG. 1 PRIOR ART
FIG. 1 is a perspective view of a prior art manually operated single piston internal feed paint roller applicator, with a roller head shown in phantom.
Figure 1A:
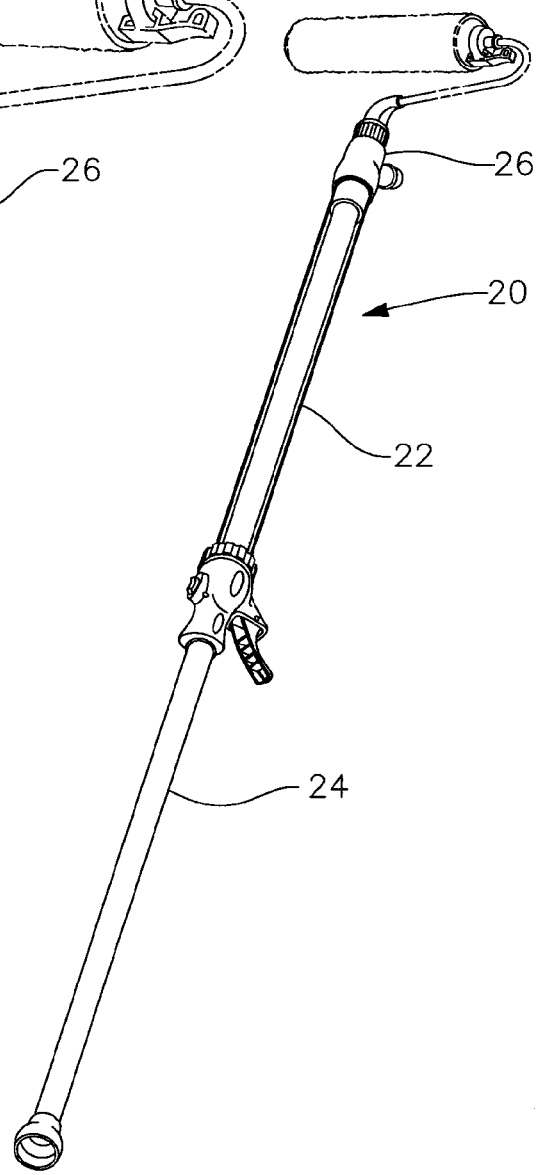
FIG. 1A PRIOR ART
FIG. 1A is a perspective view of the prior art applicator of FIG. 1, except on a reduced scale and showing a piston fully telescoped out of a reservoir in the handle of the applicator.

Referring to the Figures, and most particularly to FIGS. 1 and 1A, a prior art paint applicator 20 may be seen. This applicator is sold by Wagner Spray Tech Corporation under the PAINT MATE trademark. Applicator 20 is shown in a fully collapsed state in FIG. 1 and (in a reduced scale) in a fully extended state in FIG. 1A. Because applicator 20 has a non collapsible paint reservoir 22, the fully extended state is generally twice the characteristic length of the applicator reservoir in the fully collapsed state. Applicator 20 also has a paint applicator head such as a roller head assembly 28. Alternatively, a paint pad assembly (not shown) may be used in place of the roller head assembly 28.

In operation, a user fills the reservoir 22 by drawing a piston 24 back to load the reservoir with paint while the inlet valve 26 is in communication with a fill tube (not shown) connected to a source of paint, such as a conventional one gallon paint can or container (not shown). When the reservoir 22 is filled with paint the applicator can be unwieldy when a user desires to paint a surface in a confined space, such as a closet.

Another prior art device is a short internal feed paint applicator, offered for trim painting applications, such as the applicator sold by the assignee of the present invention under the trademark TRIM-IT. Such short paint applicators are insufficient to reach many surfaces that a user may desire to paint, and as such, users heretofore have needed to purchase both a long handled paint applicator and a short internal feed paint applicator if they desire to paint both hard to reach (distant) surfaces and surfaces in confined spaces.

The present invention provides an advantage over the prior art by providing a single applicator that is capable of painting (or applying other liquid material) to both distant surfaces and surfaces in confined spaces because of a unique collapsible liquid reservoir that can be used in a relatively short configuration as well as in a relatively long configuration, without disassembly or special adaptation by a user.

Figure 3:
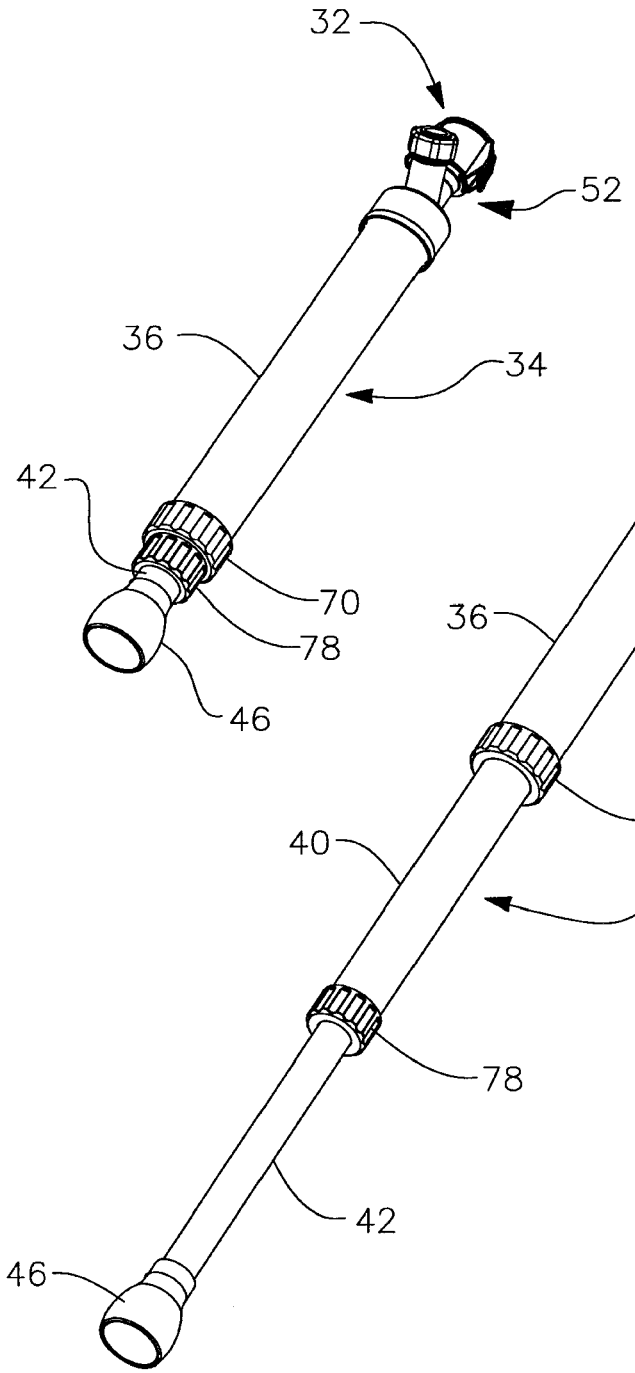
FIG. 3 is a perspective view of the handle reservoir of FIG. 2 fully telescopically collapsed.
Figure 2:
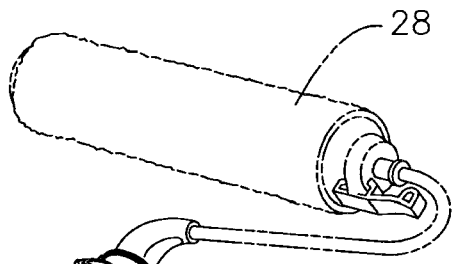
FIG. 2 is a perspective view of the dual piston liquid applicator assembly of the present invention with the roller head shown in phantom and with the handle reservoir fully telescopically extended.
Figure 4:
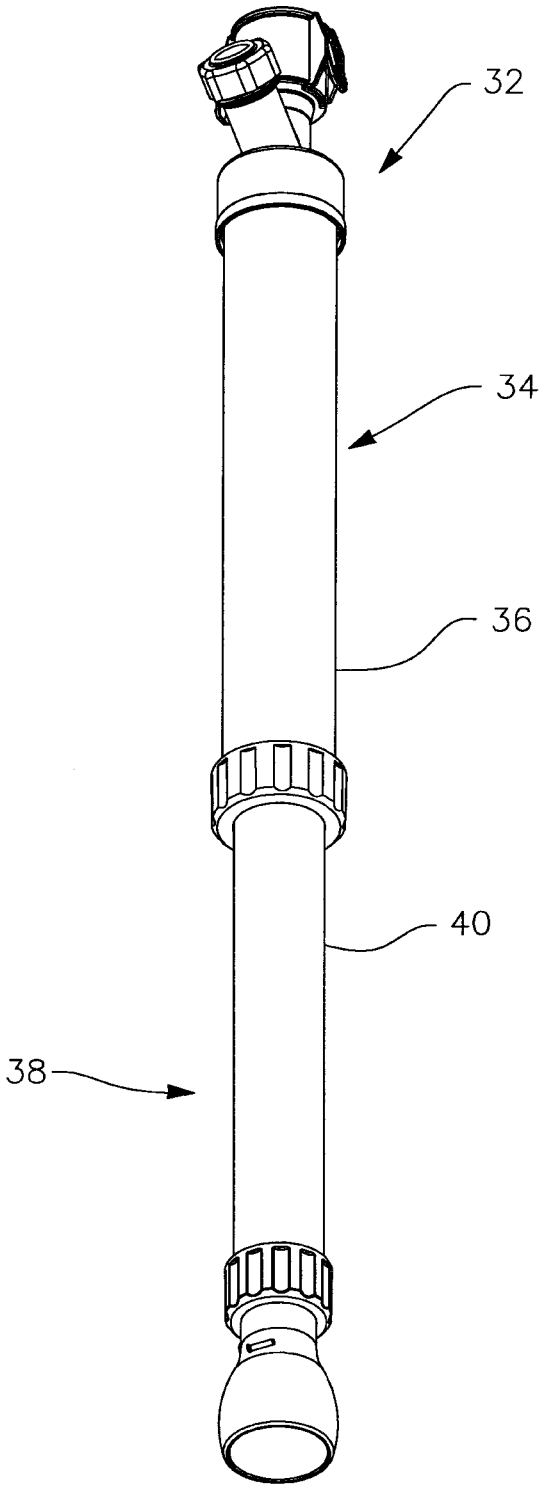
FIG. 4 is a perspective view of the handle reservoir of FIG. 2 in a first partially telescopically extended condition with only one piston extended.
Figure 5:
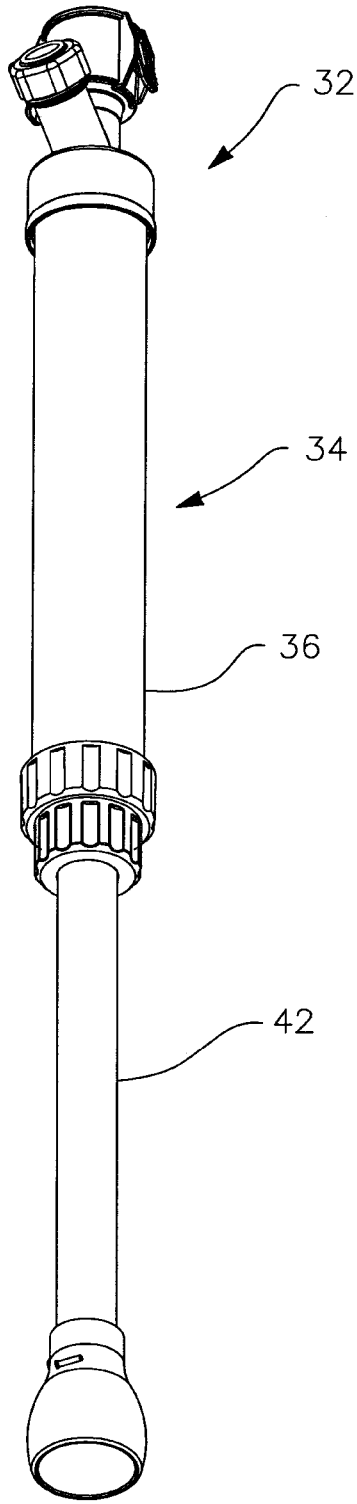
FIG. 5 is a perspective view of the handle reservoir of FIG. 2 in a second partially telescopically extended condition with both pistons extended.

Referring now to FIGS. 2 and 3, a liquid applicator 30 of the present invention may be seen. Applicator 30 has a collapsible liquid reservoir 32, which permits applicator 30 to conveniently be used in confined spaces such as closets, by partially collapsing the reservoir 32, as shown in FIG. 4 or 5. In the fully collapsed condition as shown in FIG. 3, the liquid reservoir 32 of the present invention has the added advantage of requiring less storage space than the prior art applicator 20. The applicator 30 may use the same paint applicator head such as the roller head assembly 28 or a paint pad assembly (not shown), or another paint applicator head such as a brush assembly (not shown). As a still further alternative, another liquid applicator head may be attached to the applicator 30, to remove wallpaper, for example.

As may be seen in FIGS. 2 and 3, the applicator 30 of the present invention has a first or outer cylinder 34 forming an outer chamber wall 36, and an intermediate cylinder or chamber 38 formed by an intermediate chamber wall 40 and an inner piston 42. The intermediate cylinder 38 may also be characterized as forming an intermediate piston 44 with respect to the first cylinder 34, and thus the overall design may be characterized as a double piston design internal feed paint (or liquid) applicator.

Referring now also to FIGS. 4 and 5, the collapsible liquid reservoir 32 for liquid applicator 30 (shown in FIGS. 3, 4 and 5 without the paint applicator head) is shown in FIGS. 4 and 5 in two alternative "intermediate" conditions between a fully collapsed condition (shown in FIG. 3) and a fully extended condition (shown in FIG. 2). In FIG. 4, the intermediate cylinder 38 is telescopically collapsed within the outer cylinder 34, and the inner piston 42 is telescopically extended therefrom. In FIG. 5, the intermediate cylinder 38 is telescopically extended from the first or outer cylinder 34, and the inner piston 42 is telescopically collapsed within the intermediate cylinder 38. From a user's operational viewpoint, each of the two intermediate conditions are substantially equivalent. It is to be understood that it is not necessary to intentionally or purposefully manually arrange or move the various parts of the applicator 30 from the position shown in FIG. 2 to either of the intermediate conditions of FIGS. 4 and 5, but that the parts of the applicator 30 of the present invention may assume either of the intermediate conditions during operation by themselves. It is to be further understood that other, "blended" intermediate conditions with the inner piston 42 and the intermediate cylinder 38 partially telescopically extended with respect to each other may occur during operation, without user intervention. In other words, the relative telescoping movement of (and between) the inner piston and the intermediate cylinder may occur in any fashion without affecting the operation of the present invention.

With the double piston design of the present invention, the user will preferably collapse the collapsible reservoir 32 completely (to the condition shown in FIG. 3) prior to filling. To fill the unit, the user then pulls back on a rear knob 46 to load the reservoir 32 with paint or other liquid to the extent desired. One or both of the outer and intermediate cylinders 34, 38 fill simultaneously or in sequence, which may occur in a random or quasi-random fashion. It is to be understood that it does not matter which fills first or how much liquid each fills with at any given time. The outer and intermediate cylinders 34 and 38 act together seamlessly, and the user does not have to think about or try to control which is filling or when. As with prior art products, if the user pulls the piston out halfway (in air) first, that air will remain in the reservoir and may have to be pushed out (if the roller head is positioned above the reservoir) before applying the liquid contained in the reservoir. It is intended that the user will always begin with the collapsible liquid reservoir 32 in the fully collapsed position (as shown in FIG. 3) with the present invention. After being at least partially filled with a liquid (such as paint or stain) the collapsible reservoir 32 of the present invention is preferably gradually telescopically collapsed in steps or stages as the user urges the liquid from the reservoir to the applicator head during operation. One important advantage of the present invention is that, because of the unique double piston, overall size and collapsed length is very short, while the ability to provide extended reach remains relatively long. This allows more convenient use in a tight spaces such as hallways by partially filling the unit, while still being able to reach up to the ceiling using the same tool with a complete fill. Maximum fill capacity is preferably generally equivalent to prior art devices as shown in FIGS. 1 and 1A.

Figure 6:
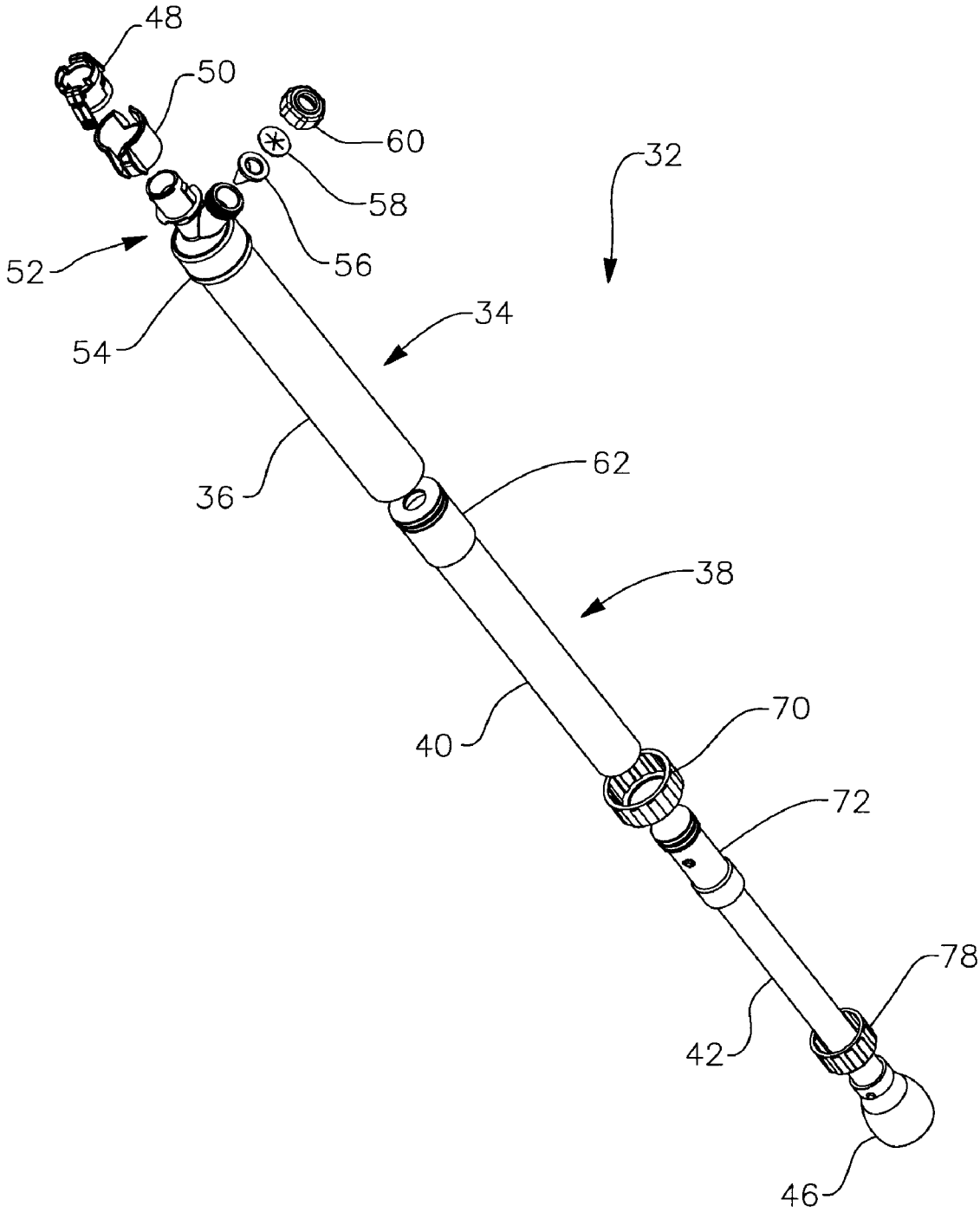
FIG. 6 is an exploded view of the handle reservoir of FIG. 2.

Referring now most particularly to FIGS. 6-10, the various parts of the present invention may be seen in more detail. FIG. 6 shows an overall exploded view, and each of FIGS. 7-10 show enlarged fragmentary exploded views of the parts shown in FIG. 6.

Figure 7:
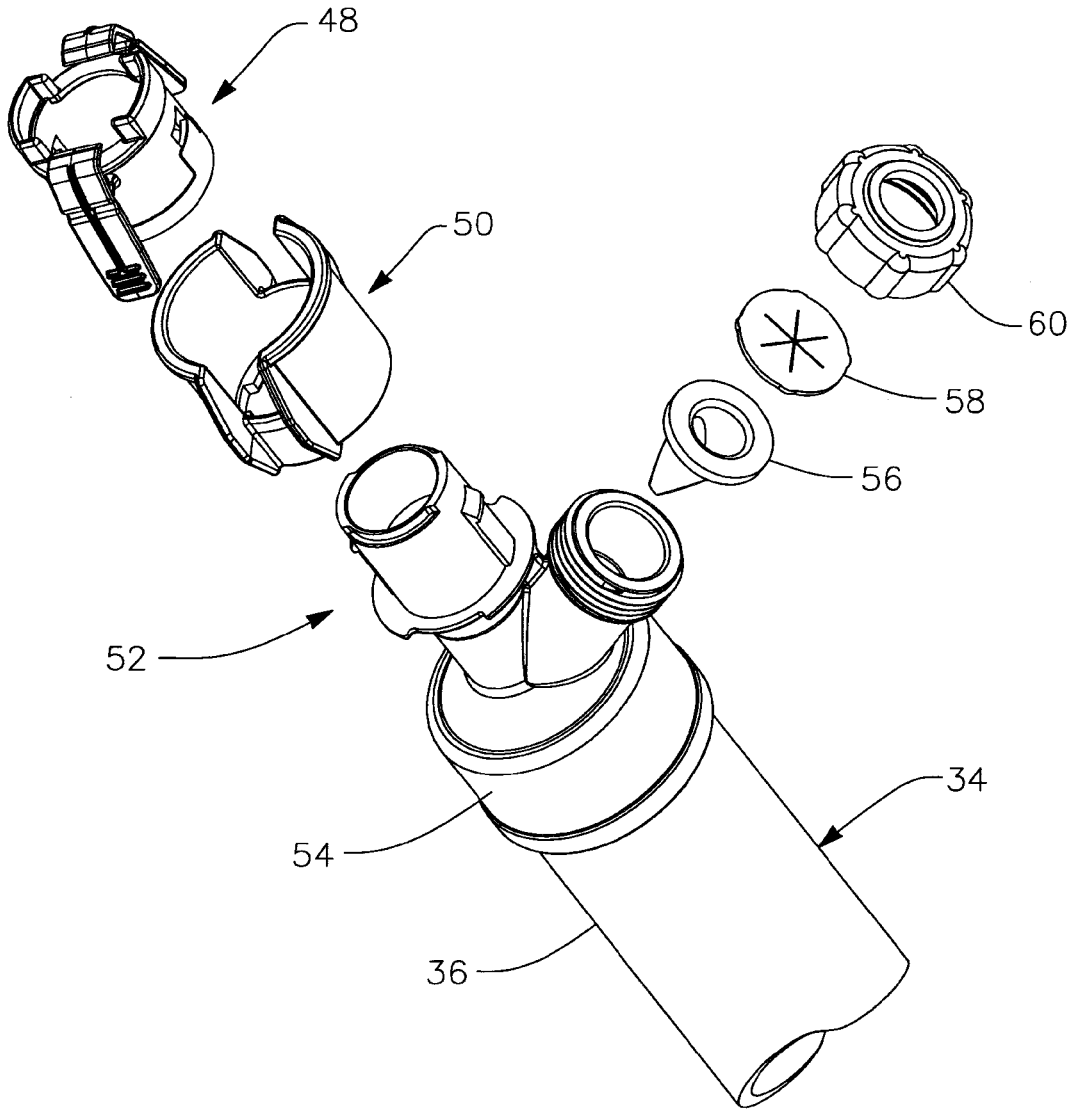
FIG. 7 PRIOR ART
FIG. 7 is an enlarged view of certain parts of the handle assembly of FIG. 6 showing details of the prior art roller head attachment collar and fill tube subassembly.

As shown in FIG. 7, the present invention may use a retainer 48 that is the same or similar to what is used in the prior art to retain the applicator head. Retainer 48 is preferably received and permanently secured to a cover 50 and an end fitting 52. End fitting 52 is preferably permanently secured to the outer chamber wall 34 via an integral collar 54. Retainer 48 also may have a duckbill valve 56 and a retainer disk 58 removably secured thereto by a threaded cap 60.

Figure 8:
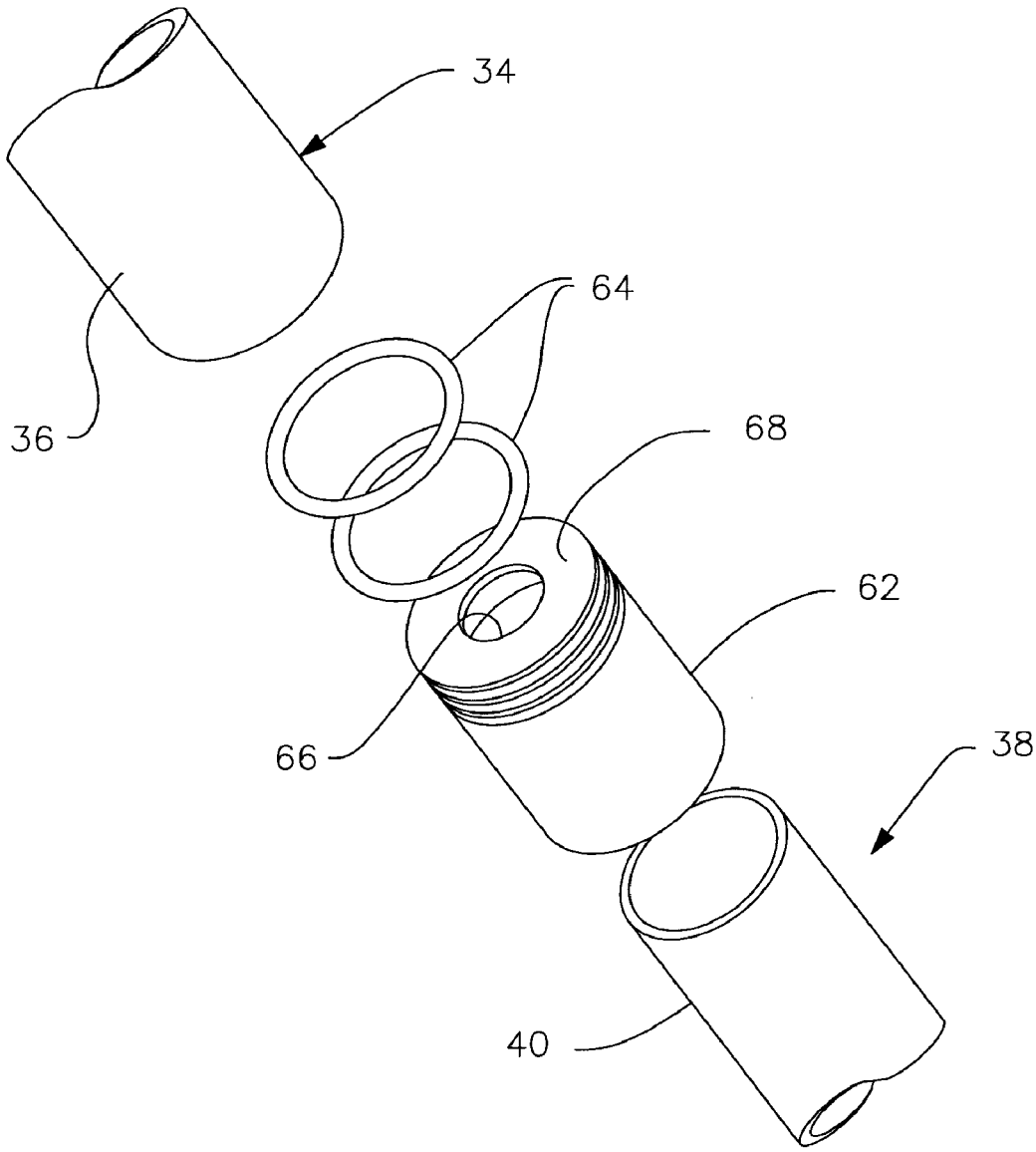
FIG. 8 is an enlarged view of certain parts further exploded from the handle assembly of FIG. 6 showing details of an intermediate chamber wall interior end cap subassembly.

Turning now most particularly to FIG. 8, the intermediate chamber wall 40 in the form of a right circular cylinder preferably has an intermediate chamber or piston end cap 62 permanently secured thereto. A pair of O-rings 64 seal the piston end cap 62 to an interior cylindrical surface of the outer chamber wall 36. Piston end cap 62 has an opening 66 in an end wall 68 thereof. Opening 66 provides for fluid communication between the interior of outer cylinder 34 and the interior of intermediate chamber 44.

Figure 9:
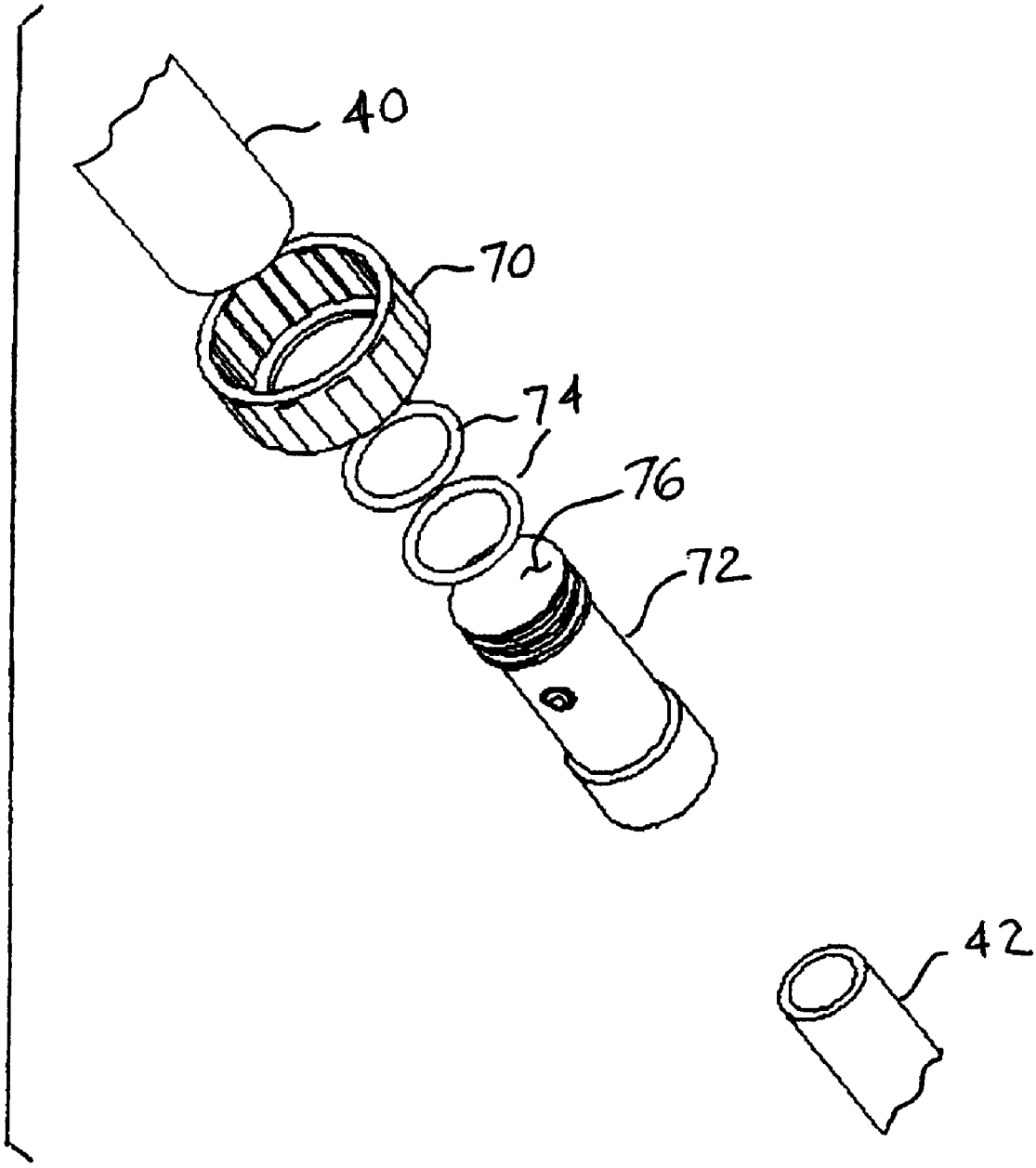
FIG. 9 is an enlarged view of certain parts further exploded from the handle assembly of FIG. 6 showing details of an end cap subassembly of a piston.

Referring now to FIG. 9, an intermediate retaining ring 70 is slidingly received over the intermediate chamber wall 40 and is preferably permanently secured to the outer chamber wall 36 (see FIG. 6). An inner piston end cap 72 is preferably permanently secured to inner piston 42, and seals against an inner surface of intermediate chamber wall 40 using a pair of piston O rings 74. Inner piston end cap 72 preferably has a solid end wall 76.

Figure 10:
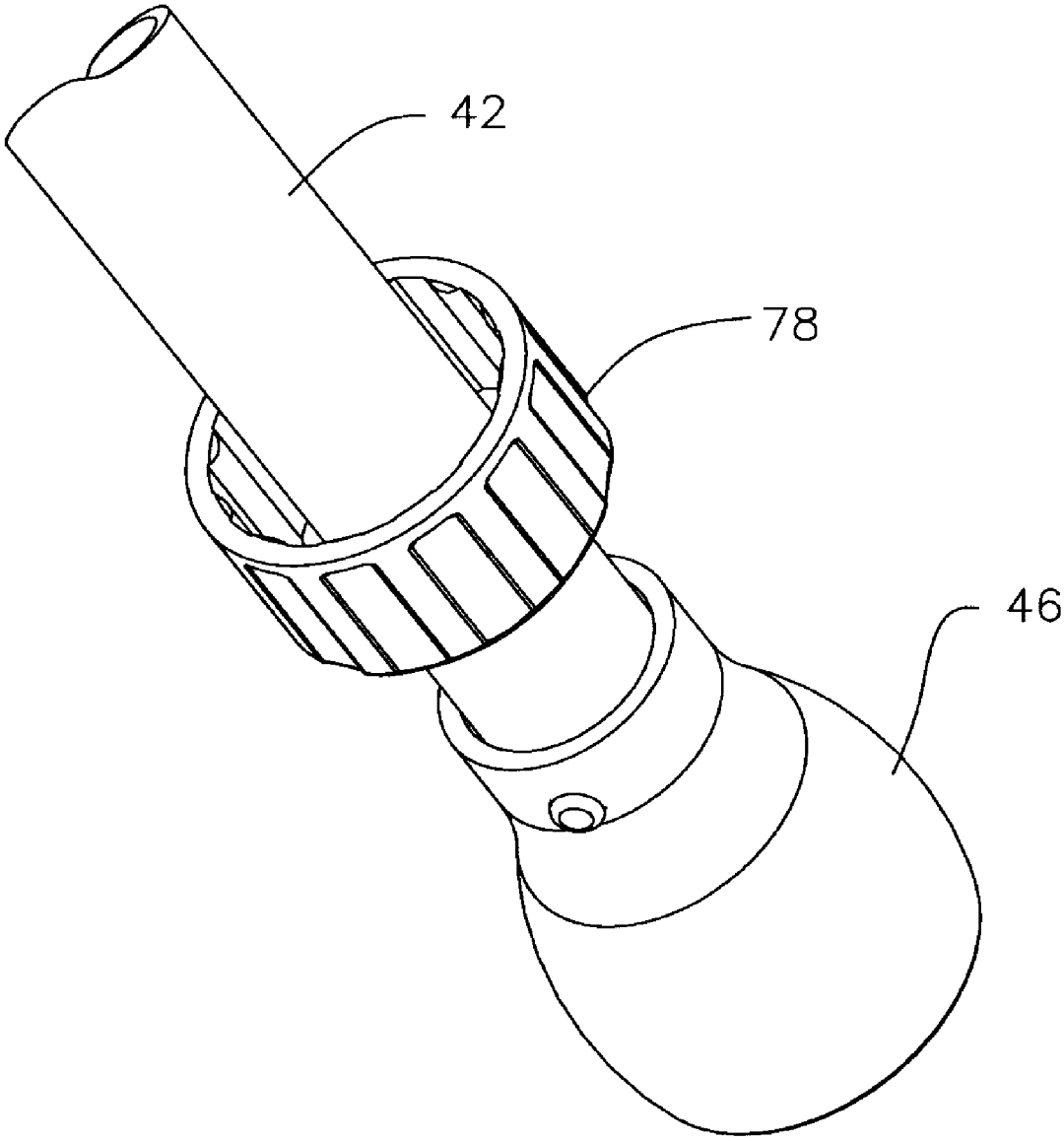
FIG. 10 is an enlarged view of an end knob and an intermediate wall retaining ring.

In FIG. 10, a piston retaining ring 78 is slidingly received over inner piston 42 and is preferably permanently secured to the intermediate chamber wall 40 (see FIG. 6). Rear knob 46 is preferably permanently secured to a proximal end of the inner piston 42. Intermediate retaining ring 70 prevents separation of the intermediate chamber 44 from the outer chamber 34 because of interference between a bore in intermediate retaining ring 70 and the intermediate piston end cap 62.

Piston retaining ring 78 prevents separation of inner piston 42 from the intermediate chamber 38 because of interference between a bore in ring 78 and inner piston end cap 72. It is to be understood that rings 70 and 78 may be permanently secured to their respective chambers, or they may be forced onto their respective cylindrical walls with a force or interference fit, if desired.

Figure 11:
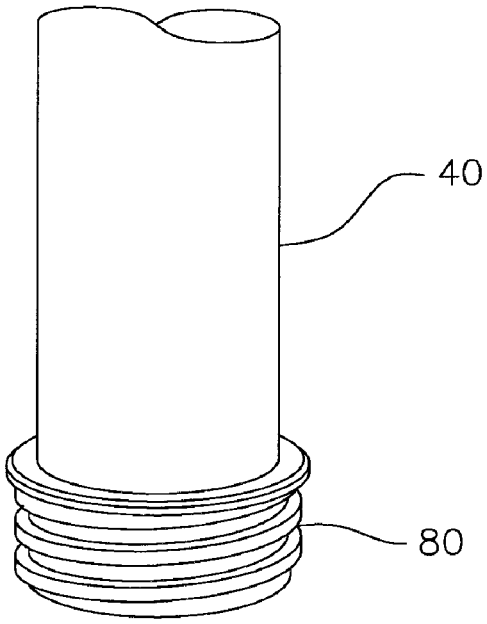
FIG. 11 is an alternative embodiment for a threaded cylinder end ring useful for removable attachment of the inner piston to the intermediate chamber.
Figure 12:
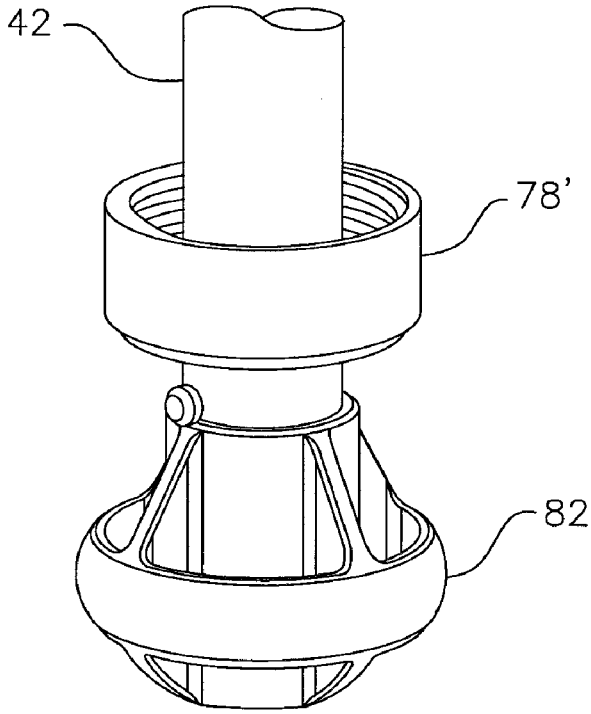
FIG. 12 shows a mating threaded retaining ring threadably receivable on the threaded cylinder end ring of FIG. 11, along with an alternative rear knob.

Referring now most particularly to FIGS. 11 and 12, in an alternative arrangement, ring 78' may be internally threaded and an externally threaded cylinder end ring 80 may be permanently secured to the intermediate cylindrical wall 40. Such an arrangement provides removable attachment of the inner piston 42 to the intermediate chamber 38 for cleaning. A similar or identical arrangement may be provided between the outer cylindrical wall 36 and the intermediate cylindrical wall 40 by adding an externally threaded end ring corresponding to ring 80 on the end of the outer cylindrical wall, and providing ring 70 with mating internal threads, to allow selective separation and attachment of the intermediate chamber 38 with respect to the outer chamber 34. FIG. 12 also shows an alternative rear knob 82 useful for urging the inner piston towards the applicator head to deliver liquid from the telescoping reservoir to the applicator head.

It is to be understood that to paint (or apply other liquid) with extended reach, the present invention is preferably operated from the fully extended condition to a partially collapsed condition, giving the same or similar reach as is available with the prior art device, while permitting a user to selectively paint (or apply other liquid) in a confined space by partially filling the reservoir and fully telescopically collapsing the reservoir 32 of the present invention.

It may thus be seen that the intermediate portion of the collapsible reservoir of the present invention may be considered either an intermediate chamber or intermediate piston when the inner piston 42 is not fully collapsed within the intermediate chamber wall 40. This is because liquids including (but not limited to) paint and similar coating materials are generally incompressible and urging the rear knob 46 towards the roller head assembly 28 will deliver liquid from the outer chamber 34 to the roller because of pressure from the inner piston and liquid (if any) in the intermediate chamber 44.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A liquid applicator having a collapsible liquid reservoir comprising:

a. an elongated outer chamber wall and a seal preventing leakage in the liquid reservoir and having a characteristic length;

b. an inner piston having a length substantially equal to the characteristic length, wherein the inner piston is telescopically received in the outer chamber wall;

c. an elongated intermediate chamber wall having a length substantially equal to the characteristic length and wherein the intermediate chamber wall is telescopically received in the outer chamber wall and located circumferentially intermediate the inner piston and the outer chamber wall, the intermediate chamber wall including an end cap having a first portion disposed circumferentially around the intermediate chamber wall and a second portion extending partially over an end of the intermediate chamber wall and defining an opening providing fluid communication between the liquid reservoirs formed by the intermediate and outer chamber walls, and including a seal preventing leakage in the liquid reservoir formed by the intermediate chamber wall, and wherein the intermediate chamber wall and the inner piston are each telescopically movable relative to one another and to the outer chamber wall, and may be telescopically expanded to i. a fully expanded condition wherein the outer chamber wall and the inner chamber wall form the liquid reservoir, and the combined length of the liquid reservoir and inner piston is about three times the characteristic length, and ii. a partially expanded condition wherein the combined length of the liquid reservoir and inner piston is substantially less than half the length of the liquid reservoir and piston in the fully expanded condition; and d. a liquid applicator head in fluid communication with the collapsible liquid reservoir.

2. The liquid applicator of claim 1 wherein the liquid reservoir and inner piston may be telescopically compressed to about one third the length of the liquid reservoir and piston in the fully expanded condition.

3. The liquid applicator of claim 1 wherein the outer chamber wall and the intermediate chamber wall and the inner piston are each generally cylindrical.

4. The liquid applicator of claim 1 wherein each of the outer chamber wall and the intermediate chamber wall and the inner piston have a right circular cylindrical overall configuration.

5. The liquid applicator of claim 1 further comprising a threaded cylinder end ring secured to the intermediate chamber cylindrical wall and the intermediate chamber end cap includes threads to mate with the threaded cylinder end ring.

6. The liquid applicator of claim 1 wherein the collapsible liquid reservoir includes liquid storage in the intermediate chamber when the inner piston is telescopically extended out from the intermediate chamber.

7. A method of applying a liquid to both distant surfaces and proximate surfaces with the same internal feed liquid applicator tool comprising the steps of:

a. telescopically collapsing a liquid applicator having a liquid applicator head in fluid communication with a collapsible liquid reservoir having an interior volume sealed against leakage of liquid contained therein and having an elongated outer chamber wall having a characteristic length and an inner piston having a length substantially equal to the characteristic length, wherein the inner piston is telescopically received in the outer chamber walls, and an elongated intermediate chamber wall having a length substantially equal to the characteristic length and wherein the intermediate chamber wall is telescopically received in the outer chamber wall located circumferentially intermediate the inner piston and the outer chamber wall and having an interior volume sealed against leakage of liquid contained therein, the intermediate chamber wall including an end cap having a first portion disposed circumferentially around the intermediate chamber wall and a second portion extending partially over an end of the intermediate chamber wall and defining an opening providing fluid communication between the liquid reservoirs formed by the intermediate and outer chamber walls, and wherein the intermediate chamber wall and the inner piston are each telescopically movable relative to one another and to the outer chamber wall, and b. telescopically expanding the liquid applicator to i. a fully expanded condition wherein the outer chamber wall and the inner chamber wall form the liquid reservoir, and the combined length of the liquid reservoir and inner piston is about three times the characteristic length to apply the liquid to a relatively distant surface and wherein the liquid reservoir interior of the outer chamber wall and the intermediate chamber wall is sealed against leakage of liquid contained therein, and ii. a partially expanded condition wherein the combined length of the liquid reservoir and inner piston is substantially less than half the length of the liquid reservoir and piston in the fully expanded condition to apply liquid to a relatively proximate surface while maintaining the liquid reservoir formed thereby sealed against leakage of liquid contained therein.

8. The method of claim 7 wherein step a further comprises telescopically collapsing the liquid applicator to about one third the length of the liquid reservoir and piston in the fully expanded condition.

* * * * *

UNITED STATES PATENT AND TRADEMARK OFFICE

CERTIFICATE OF CORRECTION

PATENT NO. : 7,682,098 B2
APPLICATION NO. : 11/672851
DATED : March 23, 2010
INVENTOR(S) : Jeffrey E. Sandahl et al.

It is certified that error appears in the above-identified patent and that said Letters Patent is hereby corrected as shown below:

Column 6, line 54, delete "walls" and insert therefor --wall--

Signed and Sealed this

Seventh Day of September, 2010

David J. Kappos

David J. Kappos
*Director of the United States Patent and Trademark Office*